US005514005A

United States Patent [19]

Jaycox et al.

[11] Patent Number: 5,514,005

[45] Date of Patent: May 7, 1996

[54] QUICK CONNECT/DISCONNECT MODULE

[75] Inventors: Donald F. Jaycox, Riverwoods; Ben Farb, Buffalo Grove; Richard T. Kaczmarek, Chicago, all of Ill.

[73] Assignee: Reliance Comm/Tec Corporation, Mayfield Heights, Ohio

[21] Appl. No.: 237,008

[22] Filed: May 2, 1994

[51] Int. Cl.[6] ..... H01R 4/24

[52] U.S. Cl. ..... 439/417; 439/709; 439/402

[58] Field of Search ..... 439/709–718, 439/721, 723, 725, 395–405, 417–419, 620, 402, 403

[56] References Cited

U.S. PATENT DOCUMENTS

| | | | |
|---|---|---|---|
| 4,652,070 | 3/1987 | Suffi | 339/97 P |
| 4,851,967 | 7/1989 | Gerke et al. | 439/723 |
| 4,952,169 | 8/1990 | Hayes, Sr. | 439/402 |
| 5,120,247 | 6/1992 | Audeval et al. | 439/403 |
| 5,139,440 | 8/1992 | Volk et al. | 439/413 |
| 5,295,857 | 3/1994 | Toly | 439/417 |

FOREIGN PATENT DOCUMENTS 2129628 5/1984 United Kingdom .

*Primary Examiner*—David L. Pirlot

*Attorney, Agent, or Firm*—Trexler, Bushnell, Giangiorgi & Blackstone, Ltd.

[57] ABSTRACT

A module for quickly and easily connecting and disconnecting electrical wires comprises a nonconductive housing having a first connector compartment for housing a first plurality of wire connectors and a second connector compartment for housing a second plurality of wire connectors. A plurality of actuators are independently and slidably mounted in the first and second connector compartments. Each of the actuators is associated with one of the wire connectors and is movable between a first position wherein a wire may be received in or removed from the actuator, and a second position wherein a received wire is electrically connected to the associated wire connector, whereby both incoming and outgoing wires may be quickly and easily connected to each other.

27 Claims, 8 Drawing Sheets

QUICK CONNECT/DISCONNECT MODULE

BACKGROUND OF THE INVENTION

This invention relates to a module for quickly and easily connecting and disconnecting electrical wires, for example in communications equipment. While the invention may have other uses, the description will be facilitated by specific reference to use of the invention in a telephone station protector module.

More particularly, the described embodiment provides a protector module which includes tool-less wire termination to insulation displacement connectors (IDC's). This module further provides for termination of a plurality of wires of one range of sizes and at least one wire of a different range of sizes to a plurality of electrically interconnected IDC's. Preferably, these tool-less connections are accomplished by means which act independently of one another such that a wire may be connected to or removed from one of the IDC's without disturbing any of the other IDC's or wires connected thereto. The described module also includes means for housing a surge protector, such as an overvoltage arrester, and for electrically coupling the protector in circuit for providing overvoltage protection for wires terminated at the IDC's. Moreover, the described protector module is configured for providing environmental sealing of the IDC terminations. Other features will be appreciated upon reading the ensuing description.

Generally speaking, telephone station protector modules have heretofore utilized stud and nut type wire terminations to couple respective tip (T) and ring (R) lines of an incoming line pair from the telephone company's central office to a subscriber's line. This typical protector module generally comprises a nonconductive or plastic housing which houses a line protector device such as a gas tube over-voltage arrester. A pair of threaded studs project from the housing and are coupled within the housing to respective ends of the gas tube arrester. The gas tube arrester has a center ground terminal such that an over-voltage condition at either of the stud terminals will be shunted to ground across one side of the gas tube. The two stud terminals are often exposed and have respective central office and subscriber line pairs coupled thereto by means of mating nuts. One such station protector is known as the model R356 station protector available from Reliance Comm/Tec Corporation, 11333 Addison Street, Franklin Park, Ill.

In connector blocks, insulation displacement connectors (IDC's) are often utilized. Often, these blocks are of a form which requires use of a special tool to terminate the incoming line and the subscriber line thereto. One type of connector block utilizing such IDC's also utilizes a screw-driven actuator to drive respective wires into the IDC's. That is, the actuator is mounted to a screw type fastener which in turn may be driven by a suitable mating tool to drive the wires into the IDC.

Connector blocks have also heretofore been provided which make use of tool-less termination to IDC's. One such insulation displacement connector terminal block is shown for example in U.S. Pat. No. 4,652,070. In this patent, a terminal block cooperates with a movable actuator to achieve termination of wires to the IDC's carried in the block. Generally speaking, the actuators are movable between a first or retracted position for receiving wires and a second or advanced position for terminating the wires with respect to the IDC's. However, the connector block shown in this patent does not provide line protectors, but only termination and/or connection points for telecommunications lines.

The copending (and commonly owned herewith) application of Suffi, Ser. No. 08/127,895, filed Sep. 28, 1993 shows an IDC terminal block of a type similar that of the above-discussed '070 patent and further including protector elements for providing overvoltage protection for the lines terminated or connected thereat.

An environmentally sealed terminal block is shown and described in U.S. Pat. No. 5,139,440 which is commonly owned herewith. However, this patent employs a threaded or screw-driven type of actuator which requires engagement by a tool for operation in terminating wires to IDC's in the block. This patent further provides for termination of one each of wires of two different wire gages or sizes to each of a pair of somewhat differently sized or configured IDC's on a common base.

OBJECTS AND SUMMARY OF THE INVENTION

It is a general object of this invention to provide a novel and improved module for quickly and easily connecting and disconnecting electrical wires.

A related object is to provide such a module in accordance with the foregoing object which further provides tool-less IDC termination of multiple wire gages.

A further object is to provide for independent connection and/or disconnection of each of the wires coupled to the module, that is, without disturbing any of the other wires coupled to the module.

A related object is to provide a module offering tool-less IDC termination of at least two differently sized wires to IDC's which are electrically interconnected.

Yet another object is to provide a module in accordance with the first-mentioned object which provides an environmental seal of the wire connected thereby.

A further object is to provide a connector member having a plurality of IDC's of one size and at least one IDC of a different size formed on a common platform.

Briefly and in accordance with the foregoing objects in accordance with one aspect of the invention, there is provided a module for quickly and easily connecting and disconnecting electrical wires, comprising a nonconductive housing having a first connector compartment for housing a first plurality of wire connectors; a second connector compartment for housing a second plurality of wire connectors; a plurality of actuators independently and slidably mounted in said first and second connector compartments, each of said actuators being associated with one of said wire connectors and being movable between a first position wherein a wire may be received in or removed from the actuator, and a second position wherein a received wire is electrically connected to the associated wire connector, whereby both incoming and outgoing wires may be quickly and easily connected to each other.

In accordance with another aspect of the invention there is provided a one-piece connector member integrally formed from a single piece of conductive material, and comprising a first connector base; a plurality of insulation displacement connectors projecting from said first connector base; a second connector base; at least one further insulation displacement connector projecting from said second connector base; a common platform interconnecting said first and second connector bases, said first and second connector bases being formed projecting in the same direction from said common platform.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
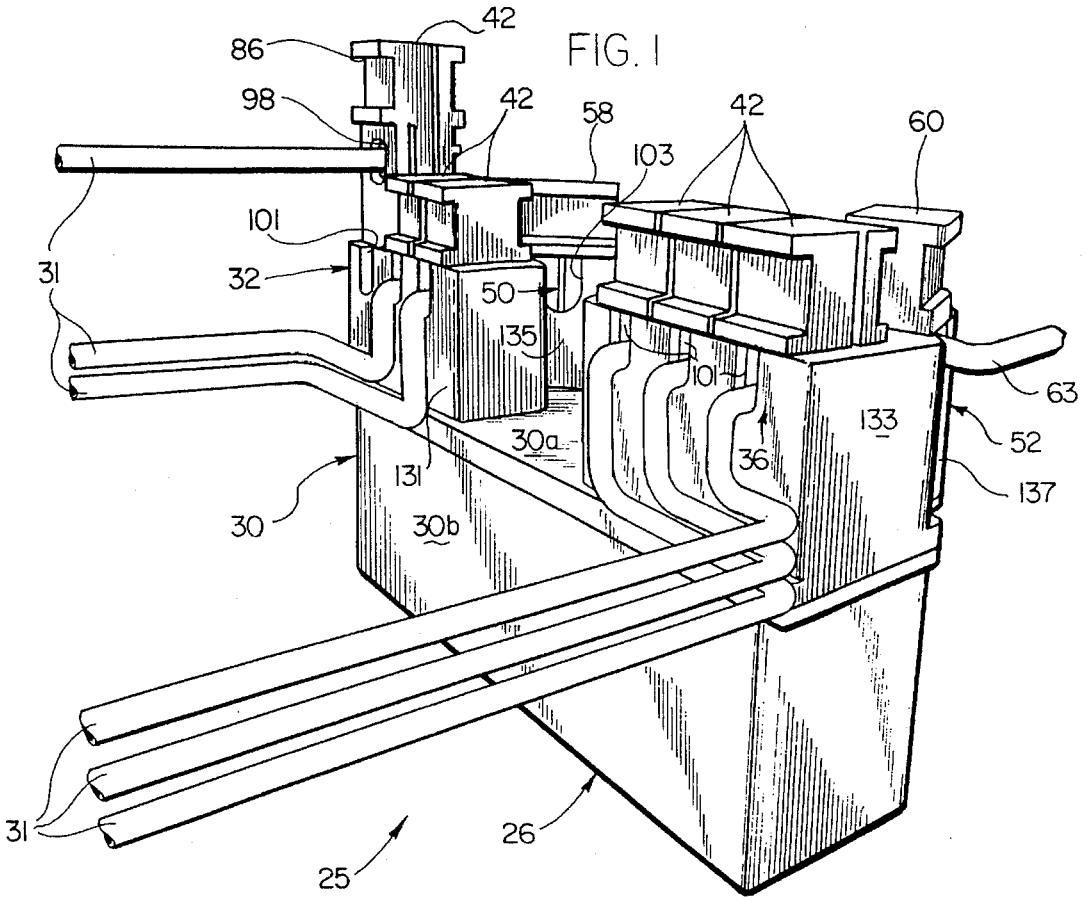
FIG. 1 is a front perspective view of a protector module in accordance with the invention.
Figure 2:
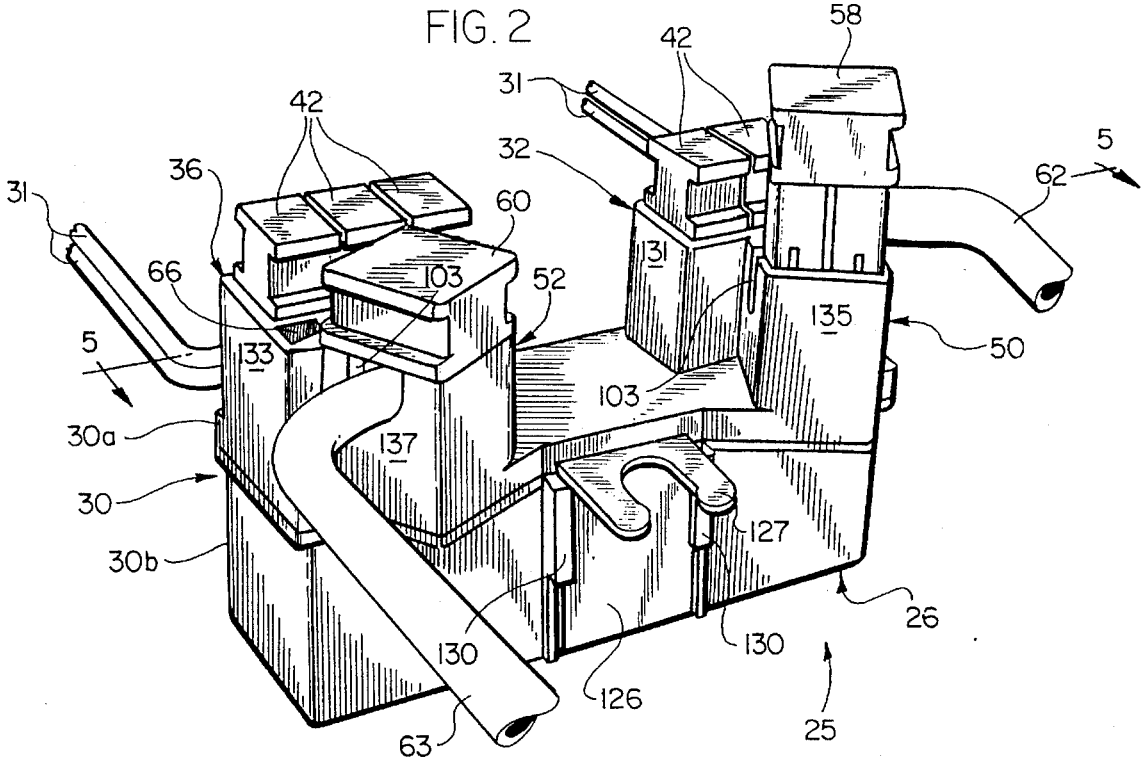
FIG. 2 is a rear perspective of the protector module of FIG. 1.
Figure 3:
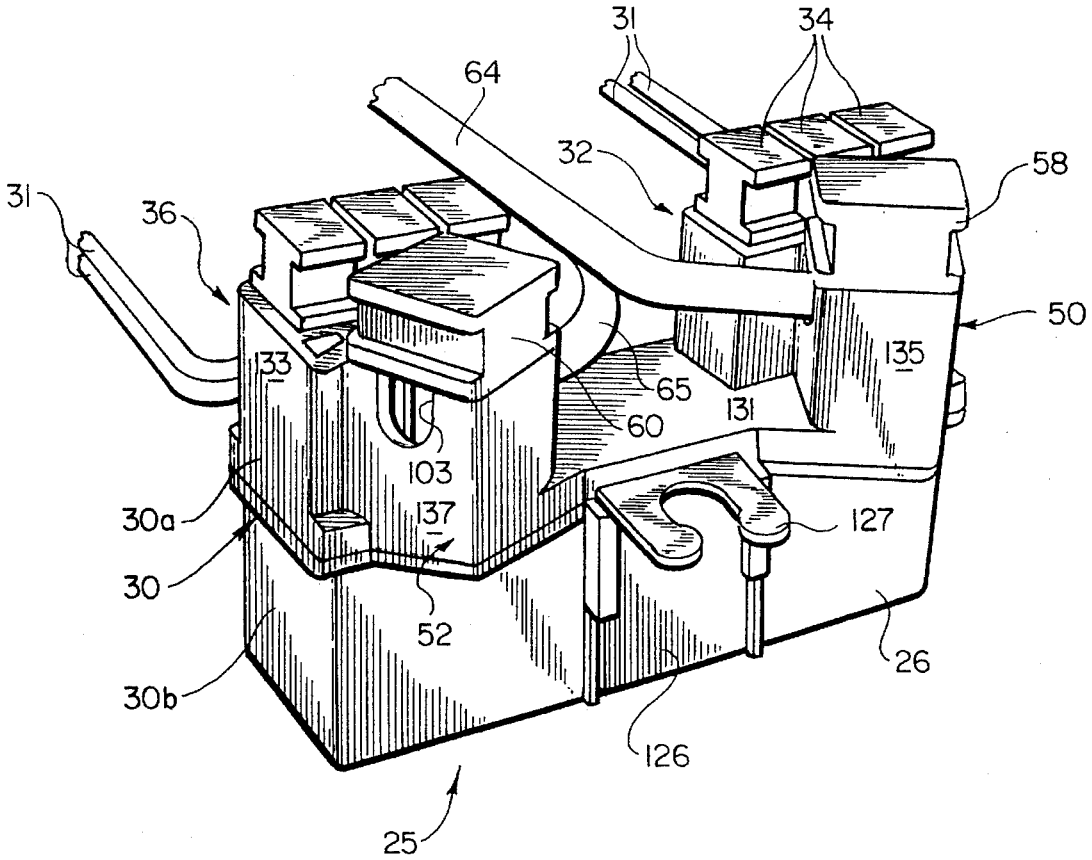
FIG. 3 is a rear perspective similar to FIG. 2 showing a modified arrangement of wire connections to the protector module.

Referring now to the drawings, and initially to FIGS. 1–3, there is shown a novel protector module embodying the invention. In the illustrated embodiment, the module 25 comprises a telephone station protector which houses a plurality of insulation displacement connectors (IDC's) or terminals for coupling respective tip (T) and ring (R) lines of an incoming line pair from a telephone company central office to a subscriber's line. The protector module 25 also includes a protector compartment 26 to be more fully described hereinbelow, which houses a line protector or arrester device for protecting the respective tip and ring lines from overvoltage conditions. A ground connector 127 projects externally of the module 25 for establishing a connection to ground from a ground terminal of an arrester 40 housed within the compartment 26. The protector module of the invention offers a number of novel features and advantages over protector modules of the prior art. The details of the structure and construction of the module 25 which give rise to these features and advantages will be more fully described hereinbelow.

Initially, the protector module 25 provides for termination of a plurality of wires of different gauges. In the illustrated embodiment, provision is made for termination of 18½, 19 or 20 gauge (AWG) drop wire plus up to three separate 22, 24 or 26 gauge (AWG) solid copper wires. The module 25 is designed to provide for quick and easy independent connection and/or disconnection of each of the wires which may be connected or terminated thereat without disturbing any of the other wire terminations. That is, individual wires may be removed for testing, replacement, reconnection or the like without disturbing any of the other wires or connections on the module 25. In the preferred embodiment illustrated and described herein, the module further provides an environmental seal of the wire connections or termination areas thereof to prevent line-to-ground IR degradation and deterioration of the wire termination contact resistance.

In addition to the foregoing, in the preferred embodiment illustrated and described herein a tool-less IDC type of wire connection is provided by the protector module 25 of the invention. Moreover, in accordance with another aspect of the invention, there is also provided a novel one-piece connector member, to be more fully described hereinbelow with reference to FIGS. 19–22. This connector member is designed for cooperation with the module 25 for simultaneously accommodating a plurality of terminations of the respective tip and ring lines of the incoming line pairs to be connected or terminated at the module 25.

Figure 4:
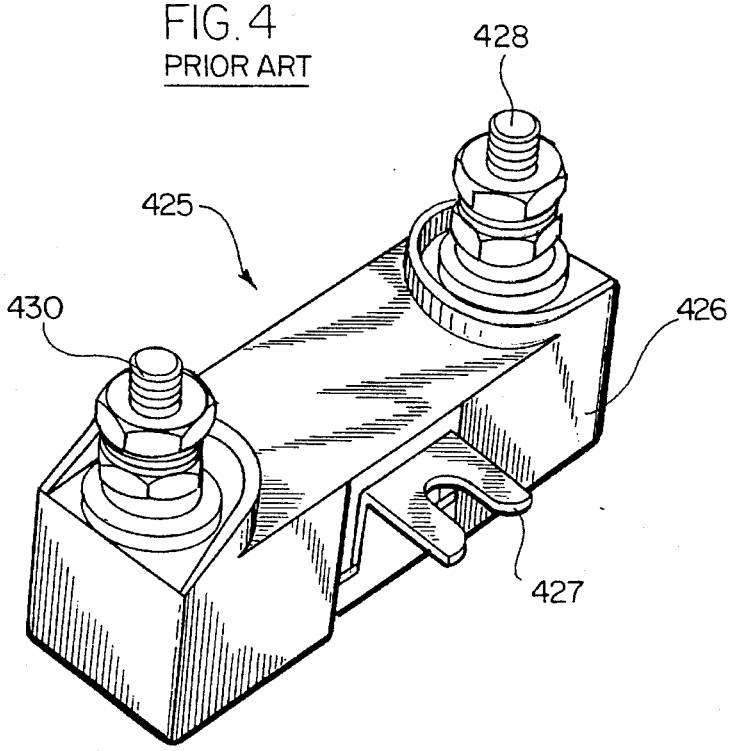
FIG. 4 PRIOR ART
FIG. 4 is a perspective view of a station protector of the prior art.

The foregoing is in contrast to a typical prior art type of station protector module 425 as illustrated in FIG. 4. In this prior art configuration a simple stud and nut type termination 428, 430 is provided for each of the tip line and the ring line of an incoming line pair and of the subscribers line. Thus, connection and disconnection is effected by means of a suitable tool. Moreover, it is generally difficult if not impossible to connect or disconnect lines to these stud and nut terminations 428, 430 without disturbing the lines previously connected thereat. This prior art module also utilized a nonconductive housing 426 which housed a line protector device such as a gas tube over-voltage arrester. A ground lug 427 coupled to a ground terminal of the gas tube arrester held within the housing 426 is visible projecting from a front side portion of the station protector module 425 of FIG. 4. This prior art module 425 is a model R356 station protector of the type mentioned hereinabove.

Referring now to FIGS. 1–3, 5 and 6, one embodiment of the protector module 25 of the invention will be described in further detail. Additional details of individual component parts of the module 25 are also shown in FIGS. 7–18, while a novel single piece connector member particularly designed for use with the illustrated module 25 is shown in FIGS. 19–22.

Referring now more particularly to the above-mentioned FIGS. 1–3, 5 and 6, the protector module 25 comprises a nonconductive housing 30 which has a first connector compartment 32 for housing a first plurality of wire connectors 34 for connection to a first telecommunications line. Preferably, the wire connectors 34 are of the IDC type as shown and described more fully hereinbelow with reference to FIGS. 19–22. These wire connectors 34 are preferably sized for terminating 22, 24 or 26 gauge (AWG) solid copper wire. A second connector compartment 36 is provided for housing a second plurality of wire connectors 38 for connection to a second telecommunications line. Preferably, the connectors 38 are of the same type and size as connectors 34 and the compartments 32 and 36 are symmetrically formed and located on the nonconductive housing 30. In the illustrated embodiment the connectors 34 and 38 are each three in number, however, fewer or more such connectors and correspondingly sized compartments might be provided without departing from the invention.

As previously mentioned, a protector compartment 26 is provided for housing a line protector device 40 which in the illustrated embodiment comprises a three element heavy duty gas tube type of arrester device, of the type generally designated by Bellcore TR-NWT-001361, such as a Siemens number T43-C350FV. However, other types of overvoltage arrester, for example a solid state arrester device, might be utilized without departing from the invention.

A plurality of substantially identical actuators 42 are slidably mounted to each of the first and second connector compartments 32, 36. Each of the actuators 42 is mounted and configured for movement independently of each other actuator 42 between a first position, as illustrated for example in FIG. 1, for receiving a wire 31 therein or for removing a wire 3 therefrom and in which position the wire 31 is disconnected from the associated one of the connectors 34 or 38, and a second position, as illustrated for example in FIGS. 2 and 3, for electrically connecting the wire 31 with one of the connectors 34 or 38 housed within the associated connector compartment 32 or 36, independently of each other connector housed within the associated compartment. That is, a wire 31 may be either connected or disconnected from respective ones of connectors 34 or 38 individually by individual movement between these two portions of respective ones of the actuators 42, without disturbing or altering connections previously established by use of others of the actuators 42 with respect to others of the wire connectors or IDCs 34, 38. Thus, as mentioned above, each wire connection to the module 25 is independent of each other wire connection thereto.

In the illustrated embodiment, all of the actuators 42, as well as their respective associated wire connectors 34, 38 are configured and located for receiving wires 31 from the same direction, or stated another way, are generally front facing, at what might be termed a "front" side of the protector module. Also, the illustrated compartments and actuators and all of the IDC's 34, 38 are configured for receiving wires entering the protector module 25 at the same height or in the same plane, as shown for wires 31 in FIGS. 1–3.

The housing 30 further defines passages or passage means 44, 46 which communicate respectively between the protector compartment 26 and each of the first and second connector compartments 32, 36. These passages permit the operative coupling of the line protector device 40 with the respective wire connectors 34 and 38 housed within the compartments 32 and 36 so as to provide line (overvoltage) protection for wires 31 coupled to the wire connectors 34 and 38. In the illustrated embodiment, the housing 30 has an upper section or portion **30*a* which defines the connector compartments 32, 36 and a lower portion 30*b* which defines the protector compartment 26; however, the housing 30** may be constructed of a single piece if desired without departing from the invention.

Figure 6:
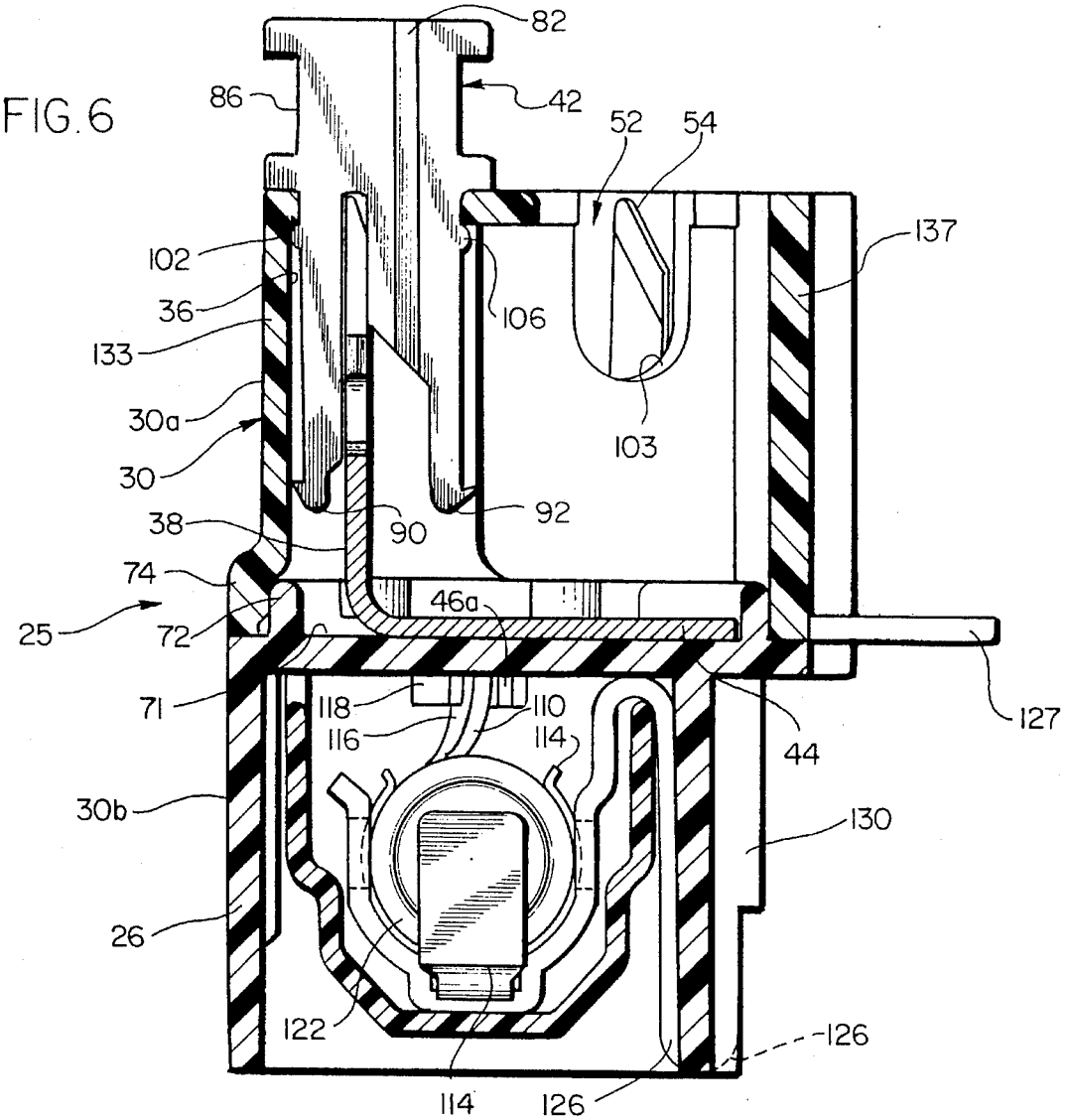
FIG. 6 is a partial fragmentary, cross-sectional, elevational view taken along line 6—6 in FIG. 5.
Figure 7:
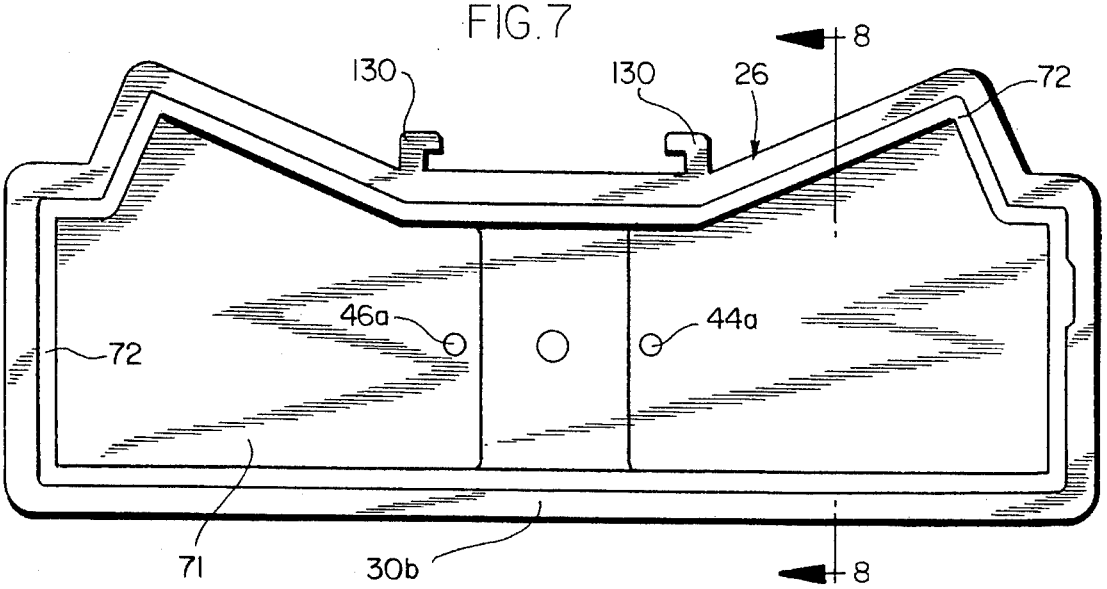
FIG. 7 is a top plan view of a bottom housing portion of the protector module of the invention.
Figure 8:
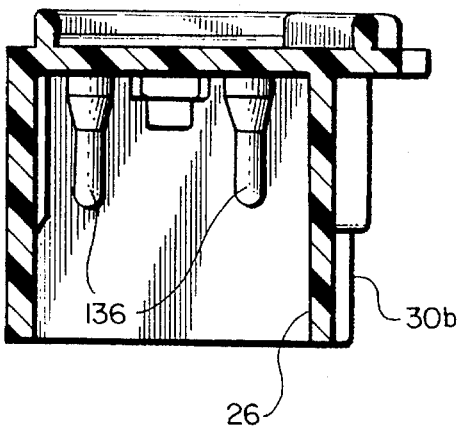
FIG. 8 is a sectional view taken generally along the line 8—8 of FIG. 7.
Figure 10:
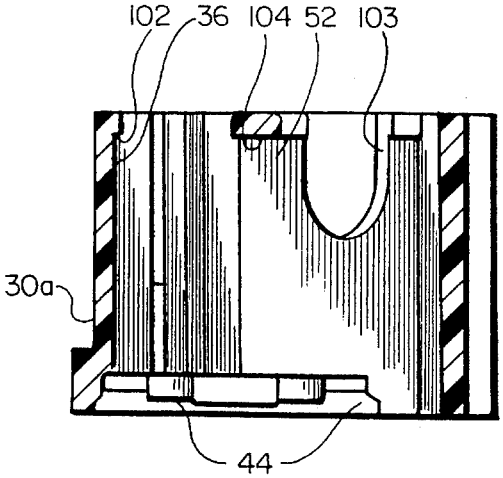
FIG. 10 is a sectional view taken generally along the line 10—10 of FIG. 9.
Figure 9:
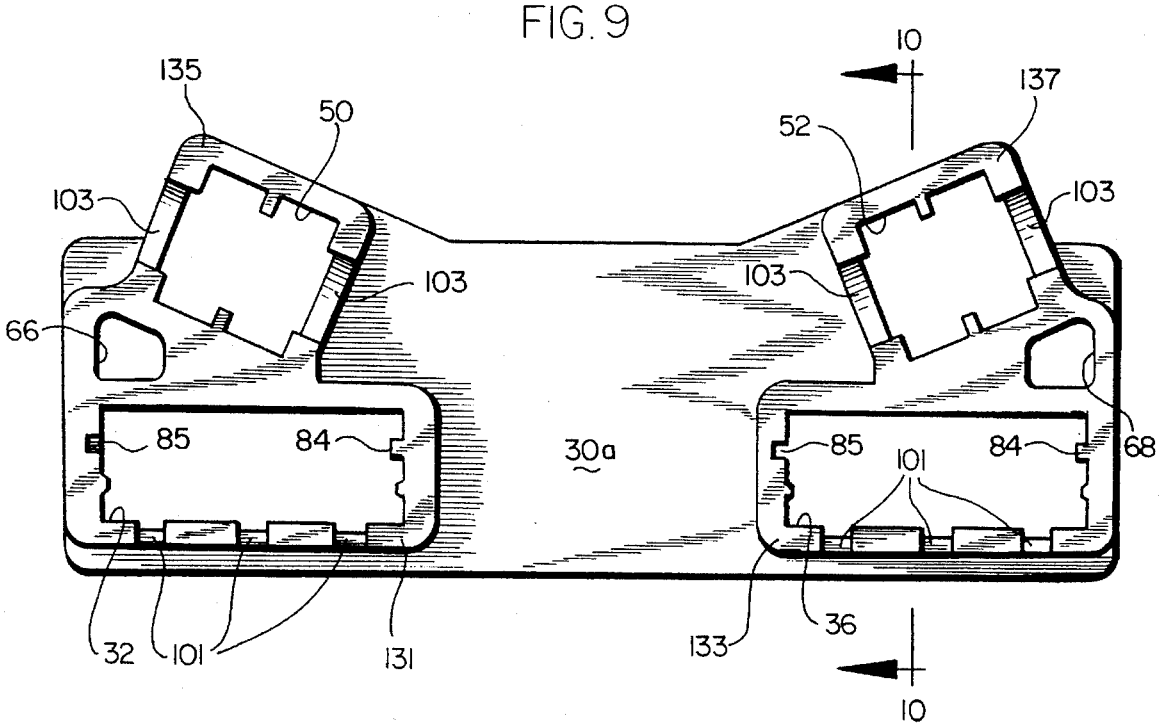
FIG. 9 is a top plan view of a top housing portion of the protector module of the invention.
Figure 11:
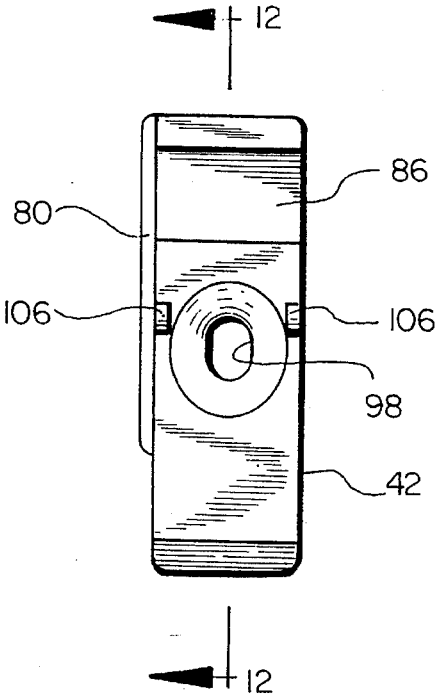
FIG. 11 is a front plan elevation of a first type of actuator member of the protector module of the invention.
Figure 12:
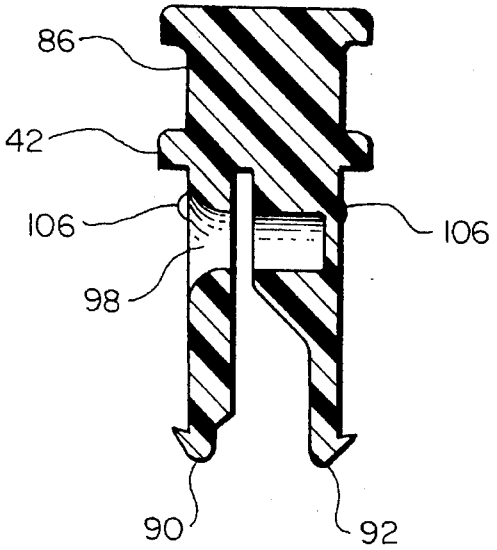
FIG. 12 is a sectional view taken generally along the line 12—12 of FIG. 11.
Figure 13:
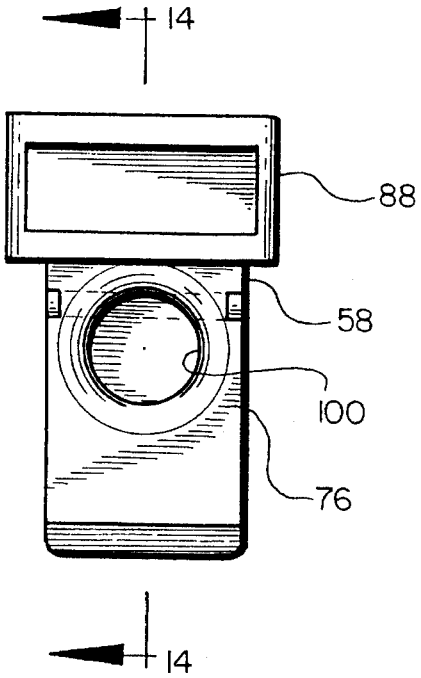
FIG. 13 is a front elevation of a second type of actuator member of the protector module of the invention.
Figure 14:
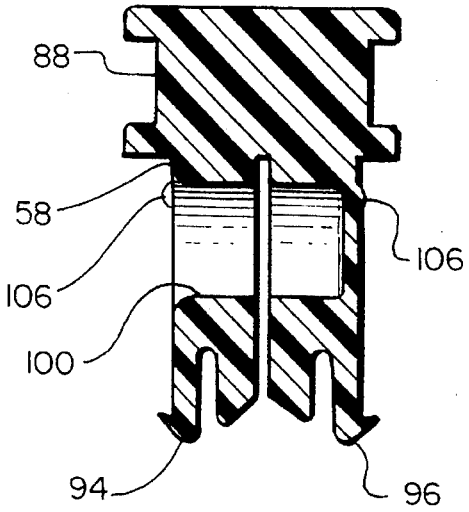
FIG. 14 is a sectional view taken generally along the line 14—14 of FIG. 13.

The housing 30 further defines respective third and fourth connector compartments 50, 52, best viewed in FIGS. 6, 9 and 10, each of which is configured for housing a wire connector 54 (see FIG. 21) which is configured for accepting a wire of a different gauge from the wires which are accepted by the wire connectors 34, 38 which are housed in the first and second connector compartments 32 and 36. In the illustrated embodiment the wire connectors 54 are also preferably of the IDC type and are preferably configured for terminating 18½, 19 or 20 gauge sold copper wire (AWG) or F drop wire.

The housing 30 also defines respective passages between the first and third connector compartments 32, 50 and between the second and fourth connector compartments 36 and 52. In the illustrated embodiment these passages are continuous with and form portions of the passages 44, 46 previously described, as best viewed in FIGS. 6 and 10. As best viewed in FIG. 6, a portion of each of the one-piece connectors 35 associated with the protector module 25 extends through one the passages 44, 46 so as to interconnect the respective terminals 34, 54 and 38, 54 thereon as well as extending to respective further connector portions 56 for interconnection with terminals of the arrester device 40 as will be more fully described hereinbelow. In this regard, the passages 44 and 46 will be seen to additionally include through openings **44*a* and 46*a* in the protector housing portion 30*b* for receiving terminals of the gas tube therethrough for connection to connector portions 56 of the two connectors 35**.

A pair of substantially identical actuators 58, 60 are slidably mounted to the respective third and fourth connector compartments for movement between a first position as illustrated for example in FIG. 2 with respect to actuator 58 for receiving a wire such as wire 62 and a second position as illustrated for example in FIG. 3 for electrically engaging a wire such as wire 64 with a connector 54 housed within the associated connector compartment 50. In this regard, it will be seen that while the connectors 34 and 38 and their respective connector compartments are configured for receiving wires from a single side or direction as described above, the connectors 54, their actuators 58, 60 and their associated connector compartments 50 and 52 are configured for accepting wires such as the wires 62 and 64 from either of two directions which in the illustrated embodiment are substantially 180° apart and are also angularly offset from the direction or side from which wires 31 are received at the connectors 34, 38 in compartments 32, 36. The actuators 56, 58, which will be more fully described hereinbelow, are reversible with respect to the compartments 50, 52 for accepting a wire from either side. This is best viewed for example with respect to the two directions of the wires 62 and 64 as illustrated respectively in FIGS. 2 and 3 with respect to the compartment 50 and its associated actuator 58.

The upper portion **30*a* of the housing 30 further includes means defining respective first and second test ports 66, 68, each for receiving a test probe (not shown) for electrical engagement with the wire connectors 34, 38 in the respective connector compartments 32 and 36. In the illustrated embodiment, the test ports 66 and 68 receive respective test points or test terminals or conductive members 70, which project from a common base or platform with the respective connectors 34, 50 on the one hand and 38, 54 on the other hand, forming a part of the one-piece connector member 35. In this regard, the previously described passages 44 and 46** also accommodate the interconnection of the respective test terminals or conductive members 70 with the other terminals 34, 54 and 38, 54 which are formed on the one-piece connector members 35. Advantageously, the provision of these test ports independently of the connectors 34, 38 and 54 and their associated actuators 42, 58, 60 permits test probes or clips to remain attached to the test terminals while still permitting the connection and/or disconnection of wires at the connectors 34, 38, 50 and 54.

In the illustrated embodiment, each of the connector compartments 32, 36, 50 and 52 comprises a plurality of side walls which define generally elongate tubular open-ended enclosures 131, 133, 135 and 137, respectively. The respective actuators 42, 58 and 60 extend from one end of the respective tubular enclosures, 131, 133,135 and 137 thus defined, while an upper or top wall portion 71 of the protector housing portion 30*b* forms a bottom wall or end wall for enclosing an end of each of the tubular connector compartments opposite the end from which the associated actuator extends. In the illustrated embodiment, each of the elongate tubular enclosures 131, 133, 135, 137 defining the respective connector compartments defines a longitudinal axis which is generally parallel and spaced from the longitudinal axis of each other one of the compartments, and moreover, the open ends of each of the compartments at which the respective actuators are received, are located substantially in a common transverse plane. However, other relative orientations of the respective compartments may be utilized without departing from the invention.

However, in the illustrated embodiment, the third and fourth compartments 50, 52 are oriented such that the wires such as wires 62, 63, or 64, 65 to be terminated at the wire connectors 54 housed therein enter from different directions than each other, and also from different directions than the wires 31 entering to be terminated at the wire connectors 34, and 38 which are housed in the first and second compartments 32, 36.

In the illustrated embodiment, sealing means are also provided for environmental sealing of the connector compartments 32, 36 and 50, 52 and of the test ports 66, 68. As already mentioned, the bottom ends of these compartments are closed by the outer surface of wall 71 on the bottom housing portion 30*b*. Additionally, it will be seen that a raised rim portion 72 extends around a periphery of this surface 71, and that this rim interfits behind a downwardly extending edge of an outer peripheral wall portion 74 of the upper housing 30*a*. Moreover, the tubular enclosures 131, 133, 135, 137 which generally define the respective compartments 32, 36, 50 and 52 are formed for closely slidably interfitting with peripheral side surfaces of the respective actuators 42 and 58. In this regard, the inner surfaces of the connector compartments 50 and 52 closely slidably interfit with outer peripheral surfaces 76 of the actuators 58. With respect to the actuators 42, three such actuators 42 cooperatively slidably interfit in a close sliding relation within each of the connector compartments 32 and 36. The close sliding interfitting of the respective actuators with 42, 48 the respective compartments thus defines means for establishing environmental sealing of the interiors of these compartments and particularly of the connectors housed therein and wires terminated or connected at each of these connectors. A quantity of a suitable sealant material (preferably electrically nonconductive) is also preferably introduced into each of compartments 32, 36, 50, 52 and in the test ports 66, 68 to effect environmental sealing.

In the illustrated embodiment, the actuators 42 further include respective cooperating interfitting raised ridges 80 and grooves 82 for slidably interfitting and aligning the actuators with respect to each other and within the connector compartments 32 and 36. Cooperatively, each of the connector compartments 32 and 36 also includes a raised ridge 84 at one end and a groove 85 at the opposite end for interfitting with the respective groove and ridge on the endmost one of the actuators 42. As mentioned above, environmental sealing is achieved by the introduction of a quantity of sealant material, such as a nonconductive grease or gel into each of the connector compartments 32, 36, 50 and 52, preferably prior to initial introduction of the respective actuators therein, and also into the test ports 66, 68.

Referring briefly to FIGS. 11–14, each of the actuators 42 and 58 includes an enlarged head or gripping portion 86, 88 which projects outwardly of the associated connector compartment when the actuator is in its second or fully recessed position for coupling a wire to its associated IDC. Each of the actuators also has a pair of legs 90, 92 and 94, 96 which project downwardly from the gripping portion 86, 88 for slidably interfitting to either side of the associated IDC or connector. Respective apertures 98, 100 are provided, in one each of the respective actuators, extending completely through a first of the legs and partially through the other of the legs so as to provide an external opening sized to receive a wire of one of the sizes mentioned hereinabove for connection to an associated IDC or connector.

These apertures 98, 100 completely surround an associated wire, such that the actuators operate to both connect and disconnect wires relative to the IDC connectors 34, 38 and 54. Preferably, the respective legs terminate in barbed ends so as to permit the legs to initially deform inwardly somewhat for snapping engagement of the actuator with its associated connector compartment, and thereafter to oppose full withdrawal of the actuator relative to its associated connector compartment by engagement with an inwardly projecting lip portion 102, 104, at an upper edge of the compartment (see FIGS. 6 and 10). This engagement also defines the first or "up" position of the actuator for receiving a wire for connection to the associated IDC. The second position is defined by engagement of a lower end of the enlarged gripping portion 86, 88 with the top outer surface of the respective associated connector compartment. Also, respective rounded detent projections or bosses 106 are provided on the actuators 42 and 58 for further detenting the actuators in the second or recessed position for connection of a wire to the associated IDC.

The apertures 98 of the actuators 42 face forward for alignment with generally open-topped U-shaped slots 101 which are formed in the forward faces of the walls 131, 133 which form the respective connector cavities 32 and 36. The actuators 54 may be oriented facing either of two directions within cavities 50 and 52 which are provided with similar, oppositely facing generally U-shaped slots 103 in their top portions for alignment with the opening 100. The two possible orientations of these actuators 54 and of wires entering from opposite sides of cavities 50 and 52 are illustrated respectively in FIGS. 2 and 3.

Figure 5:
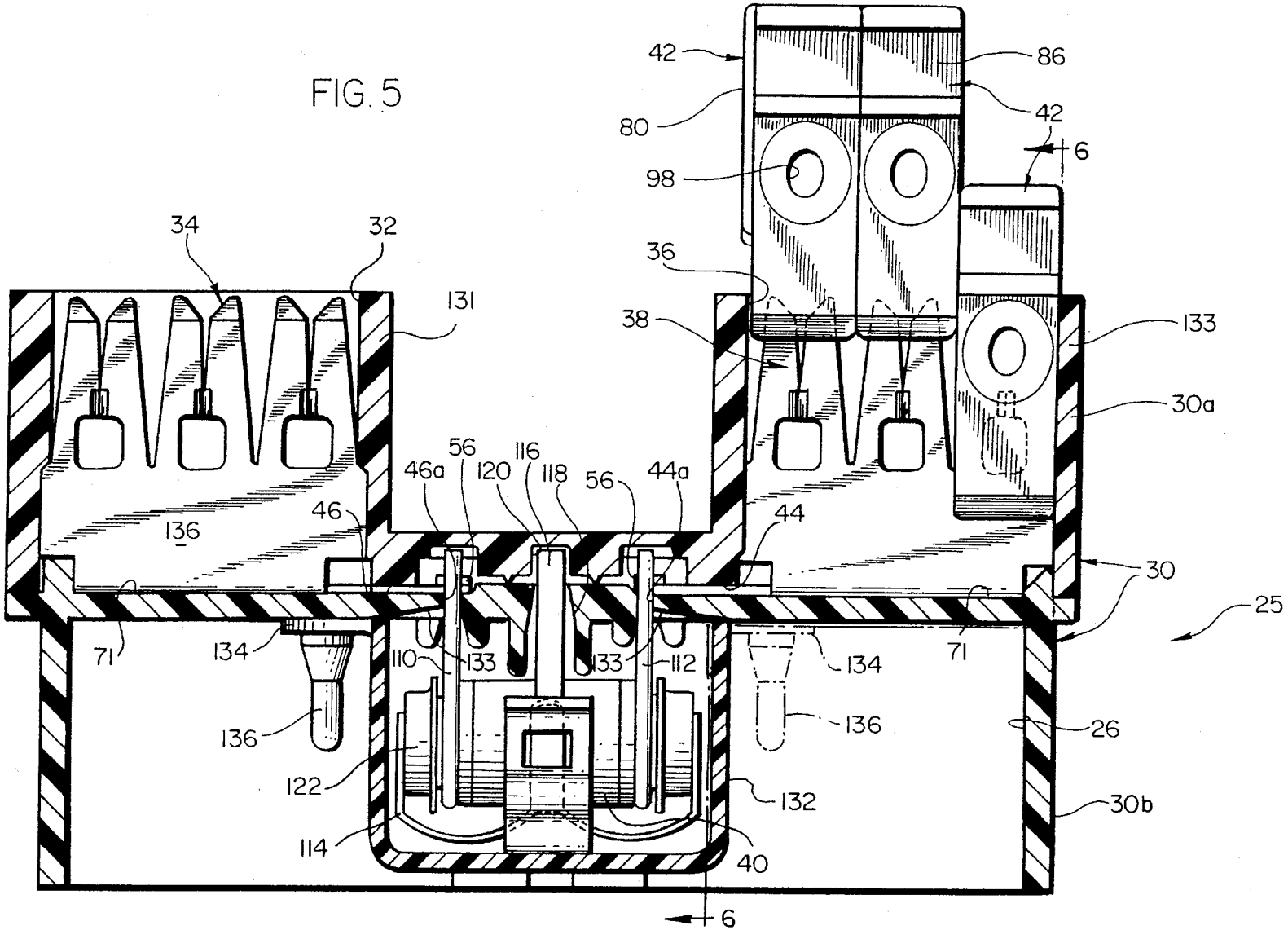
FIG. 5 is a partial fragmentary, cross-sectional, elevational view taken along line 5—5 in FIG. 2.

Referring now to FIGS. 5 and 6 and also to FIGS. 15–18, some further details of the arrester 40 and associated structures will be briefly described. As mentioned above, the arrester 40, preferably comprises a gas tube type arrester which is housed within a generally cylindrical container. This container preferably houses two arrester elements, one for overvoltage protection of each of the two sets of terminals 34, 54 and 38, 54 which are housed within the respective associated sets of connector compartments 32, 50 on the one side (as viewed in FIGS. 5 and 9), and compartments 36 and 52 on the other side. As mentioned previously with reference to FIGS. 17–19 each of these sets of connectors is integrally formed as a single piece connector 35 (see FIGS. 19–22). The gas tube may comprise a Siemens gas tube type number T43-C350FV for example.

Opposite ends of the gas tube 40 are formed of conductive metallic material, and respective terminals 110, 112 are wrapped thereabout and extend upwardly through the apertures 44*a* and 46*a* for connection with the respective connector portions 56 of connectors 35 to either side thereof. A dual ended generally M-shaped spring clip member 114 embraces a center portion of the gas tube and is in electrically conductive contact with a ground terminal or electrode 116 which is formed thereon, and which may also extend through dummy or alignment apertures 118, 120 formed in the housing portions 30*a* and 30*b*. At either end the spring clip 114 urges a cup-shaped shunt cup member 122 toward an opposite end of the gas tube 40. Within the shunt cup member 122 is contained a vent safe device and fusible element, preferably a solder pellet (not shown). The vent safe device and solder pellet provide respective vent safe and fail safe features, as generally understood in the gas tube arrester art.

Figure 15:
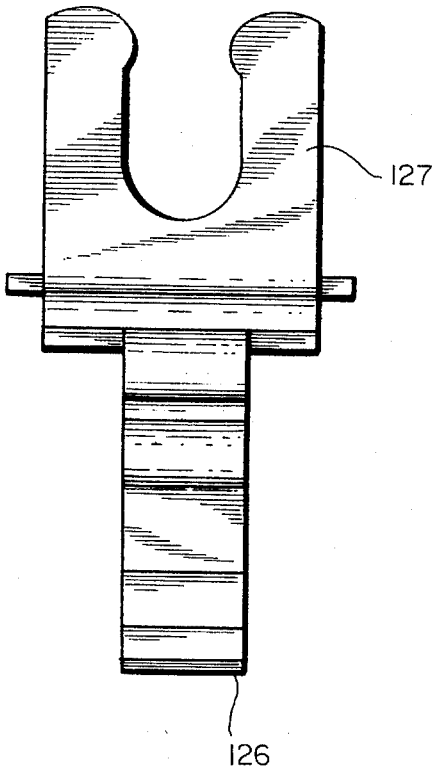
FIG. 15 is a front elevation of a ground clip portion of the protector module of the invention.
Figure 16:
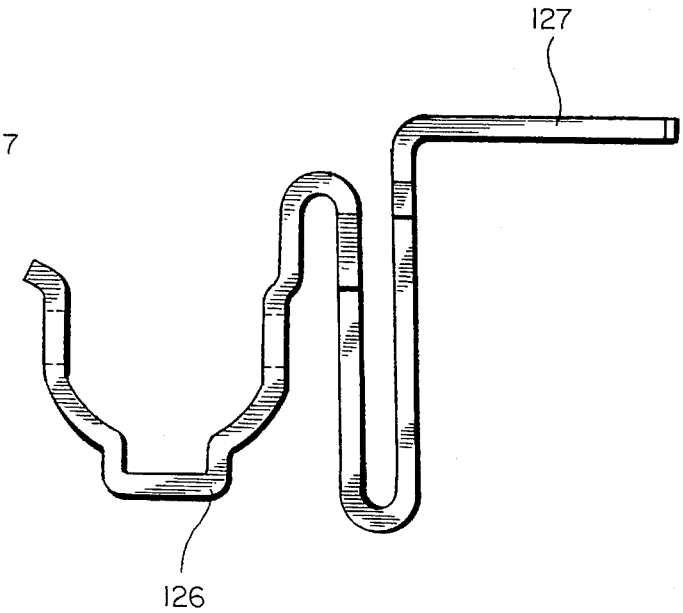
FIG. 16 is a side elevation of the ground clip of FIG. 15.

A ground clip 126, which is best viewed in FIGS. 15 and 16, and is preferably formed of a resilient spring-like conductive metallic material, surroundingly embraces and electrically contacts the center or ground electrode 116 of the gas tube. The ground clip 126 exits the housing portion 30*a* at a lower portion thereof and extends back upwardly along an outer surface thereof to terminate in a generally perpendicularly outwardly projecting ground lug or terminal 127. The lower housing portion 30*b* is formed with respective L-shaped channels or guides 130 for receiving edge portions of the ground clip 126 in this regard.

Figure 17:
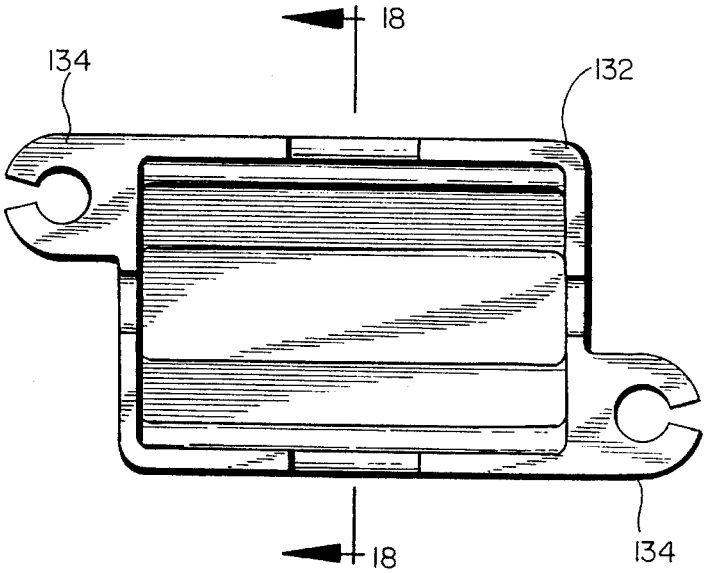
FIG. 17 is a top plan view of a protector element cover member of the protector module of the invention.
Figure 18:
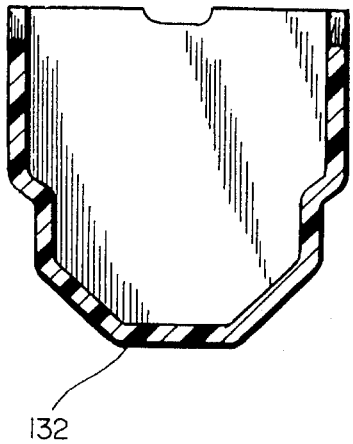
FIG. 18 is a sectional view taken generally along the line 18—18 of FIG. 17.
Figure 19:
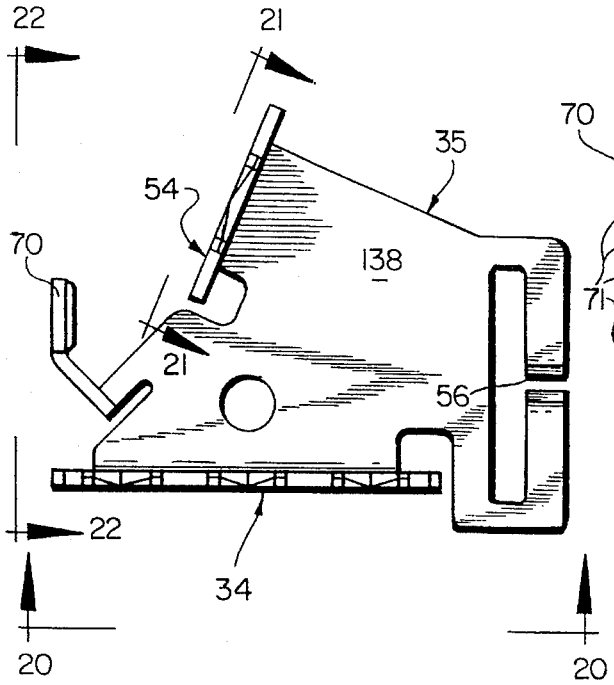
FIG. 19 is a top plan view of a connector member of the protector module of the invention.
Figure 20:
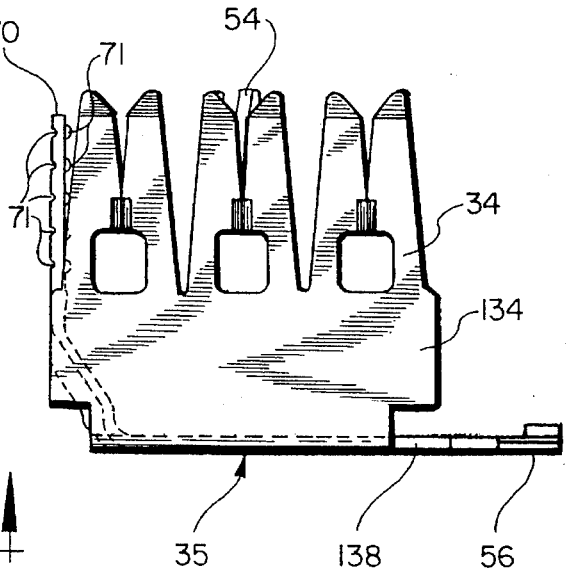
FIG. 20 is a side elevation taken generally along the line 20—20 of FIG. 19.
Figure 21:
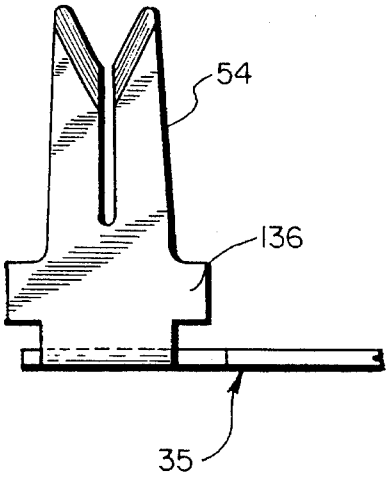
FIG. 21 is a side elevation taken generally along the line 21—21 of the FIG. 19.
Figure 22:
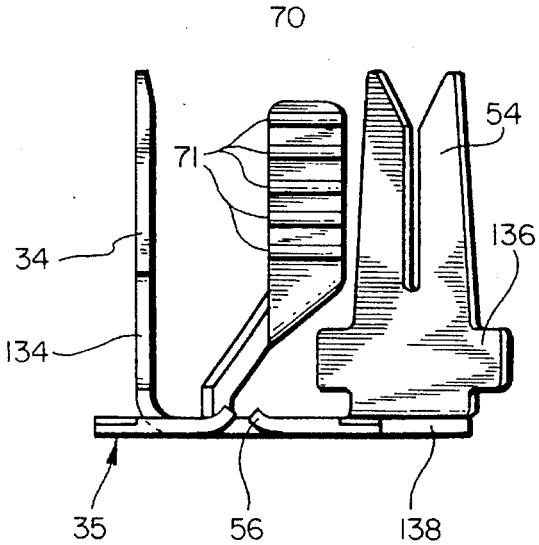
FIG. 22 is an elevation taken generally in the plane of the line 22—22 of FIG. 19.

The gas tube or arrester and related parts just described are preferably housed within a further protective housing or cover member 132, details of which are shown in FIGS. 17 and 18. In the illustrated embodiment, the cover member 132 has oppositely outwardly projecting apertured ears 134 which preferably interfit over cooperatively formed and located projecting lugs 136 formed interiorly of the lower housing portion 30*b*. The cover 132 may be sonic welded or otherwise secured relative to the lugs 136, and a quantity of sealant material may be introduced therein in order to seal the gas tube and related parts environmentally, if desired. The cover 132 also provides a bell jar effect, i.e., will create an "air bubble" to protect the gas tube and other contents from flooding/rising water conditions, and to further enhance environmental sealing of the gas tube. Also, a quantity of potting material (not shown) is preferably added after assembly of the gas tube and cover 132, completely filling the hollow bottom housing section 30*b*. Some of this potting material will flow under the edges of cover 132 (at ramped surfaces 133—see FIG. 5) to seal about the electrodes 110, 112 where they run through apertures 44*a* and 46*a*.

Referring now to FIGS. 19–22, in accordance with another aspect of the invention there is provided a novel one-piece connector member 35, which has been partially described hereinabove. The one-piece connector member 35 includes a first connector base portion 134 from which project the first plurality of insulation displacement connectors 34. At least one further insulation displacement connector, namely the second connector 54 projects from a second connector base 136. A common platform 138 joins the two connector bases 134 and 136. In the preferred embodiment illustrated, the first and second connector bases 134, 136 are formed projecting in the same direction from the common platform 138, and at substantially right angles thereto. The connector portion 56 for electrical interconnection to the line protector or arrester device 40 also projects from the common platform 138, and in the illustrated embodiment projects in generally in the same plane as the platform 138.

As previously described, the insulation displacement connectors 34 are configured for terminating wires of a first range of wire sizes, and in the illustrated embodiment, preferably 22, 24 and 26 AWG, whereas the insulation displacement connector 54 is configured for terminating a wire of a size outside this range of size, and, as previously mentioned, preferably wire sizes of 18½, 19 and/or 20 AWG. In the illustrated embodiment, all wire sizes referred to are solid copper wire. It should be appreciated that the respective connector members 34 and 54 may be configured for terminating wire of other wire sizes and types without departing from the invention.

Generally speaking, lack of the insulation displacement connectors 34 and 54 are of the type which comprise a pair of cantilevered beams projecting from the associated connector base 134, 136 and configured for terminating a wire therebetween while stripping the insulation therefrom. In the embodiment illustrated, the connector 35 also includes the test point or test terminal 70 as a projecting conductive member which also projects from the common platform 138 and preferably in generally the same direction as the respective terminals 34 and 54. As illustrated, the test terminal or conductor 70 is also oriented at substantially right angles to the platform 138. Preferably the test terminal 70 has relatively flat surfaces, across which are formed a number of parallel embossments 71 to enhance gripping thereof by a test clip (not shown).

In the illustrated embodiment, the connector member 35 is configured such that the respective connectors 34, 54 and test terminal 70 conveniently interfit with the respective connector compartments 32 and 50 and the test cavity 66 as illustrated for example in FIG. 9. It will be understood that a second substantially similar one-piece connector, not shown in FIGS. 19–22, would form substantially a mirror image of the illustrated connector 35 for cooperatively interfitting within the respective connector compartments 36 and 52 and test cavity 68 illustrated in FIG. 9. Furthermore, the respective connectors 56 project mutually inwardly for connection to respective terminals or electrodes 110, 112 of the arrester 40 which project through respective openings 44*a* and 46*a* as previously described. In the illustrated embodiment, all of the connectors 34, 54 are of substantially the same height relative to the platform 138. The test conductor 70 is somewhat shorter so as to be somewhat recessed within it associated cavity 66, but easily reachable with a test probe.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The Invention is claimed as follows:

1. A module for quickly and easily connecting and disconnecting electrical wires, said module comprising: a non-conductive housing having a first connector compartment for housing a first plurality of wire connectors; a second connector compartment for housing a second plurality of wire connectors;

a plurality of non-threaded actuators independently and slidably mounted in said first and second connector compartments, each of said actuators being independently associated with a corresponding one of said wire connectors and being independently slidably movable between a first position wherein a wire is received in the actuator, and a second position wherein a received wire is electrically connected to the associated wire connector, whereby both incoming and outgoing wires may be quickly and easily connected to each other by way of said wire connectors in said first connector compartment being coupled with said wire connectors in said second connector compartment, said module providing for individual termination of said line for avoiding interruption of service and surge protection means retained in said module and being operatively associated with said first and second connector compartments and coupled to said wire connectors housed in said first and second connector compartments for providing protection to the wires connected thereto.

2. A module according to claim 1, said surge protection means further including a surge protector compartment and defining passage means communicating between said surge protector compartment and each of said first and second connector compartments for operatively coupling a surge protector device to wire connectors housed in said first and second connector compartments to provide surge protection for wires coupled to wire connectors housed in said connector compartments.

3. A module according to claim 1 and further including sealing means for providing environmental sealing of said first and second connector compartments.

4. A module according to claim 1 and further including a quantity of sealant material introduced into each of said first and second connector compartments.

5. A module according to claim 1, said housing further including first and second test ports, each for receiving a test probe for electrical engagement with wire connectors respectively in said first and second connector compartments independently of wire connection to said wire connectors.

6. A module according to claim 1 wherein said housing includes a first test port for accommodating a conductive member defining a first test point and a second test port for accommodating a conductive member defining a second test point, and wherein said housing defines passage means to permit electrical interconnection of said first test point with wire connectors housed in said first connector compartment and of said second test point with wire connectors housed in said second connector compartment.

7. A module according to claim 1 wherein each of said first and second connector compartments and the associated actuators have cooperatively slidably interfitting ridges and grooves for locating and aligning said actuators with respect to said connector compartments and for permitting independent movement of each of said actuators between said first and second positions.

8. A module according to claim 1 wherein each of said first and second connector compartments comprises a plurality of sidewalls defining a generally elongate tubular open-ended enclosure, said actuators extending from one end thereof, and end wall means for enclosing an end thereof opposite said one end.

9. A protector module according to claim 8 and further including cooperating interfitting portions on said first and second connector compartments and on said actuators for enclosing one open end of each of said connector compartments when all of the actuators associated with that compartment are in said second position.

10. A module according to claim 1 and further including third and fourth connector compartments, each being configured for housing a wire connector configured for accepting a wire of a different gauge from wire connectors housed in said first and second connector compartments.

11. A module according to claim 10 wherein said housing further defines respective passageways between said first and third connector compartments and said second and fourth connector compartments for accommodating electrical interconnections between connectors housed in said first and third compartments and between connectors housed in said second and fourth compartments, respectively.

12. A module according to claim 10 and further including sealing means for environmentally sealing said connector compartments.

13. A module according to claim 10 and further including a further actuator slidably mounted to each of said third and fourth connector compartments for movement between a first position wherein a wire may be received in or removed from said actuator, and a second position wherein the received wire is electrically connected to the connector housed within the associated connector compartment.

14. A module according to claim 13 wherein said third and fourth compartments are configured for receiving wires to be terminated at wire connectors housed therein from opposite directions, and wherein each of said further actuators is configured for reversibly slidably interfitting with the associated compartment for receiving and connecting a wire entering from either of said opposite directions.

15. A module according to claim 13 wherein each of said connector compartments comprises a plurality of sidewalls defining a generally elongate tubular open-ended enclosure, the associated one or ones of said actuators projecting from one end thereof, and end wall means for enclosing an end thereof opposite said one end.

16. A module according to claim 15 wherein each of said actuators and its associated compartment include cooperating interacting stop means for defining said first and second positions of each said actuator.

17. A module according to claim 15 and further including cooperating interfitting portions on said actuators and on said compartments for enclosing one open end of each of said compartments when all of the actuators associated therewith are in said second position, for environmentally sealing said connector compartments.

18. A module according to claim 17 and further comprising a quantity of sealant material in each of said connector compartments.

19. A one-piece connector assembly integrally formed from a single piece of conductive material, and comprising: a first connector base; a plurality of individual insulation displacement connectors projecting from said first connector base, for connection with a corresponding plurality of individual wires, said connectors being generally positioned in a common plane; a second connector base; at least one further individual insulation displacement connector projecting from said second connector base, for connection with a corresponding individual wire; a common platform interconnecting said first and second connector bases, said first and second connector bases being formed projecting in the same direction from said common platform.

20. A connector member according to claim 19 and further including a further connector portion projecting from said common platform for electrical connection to a surge protector device.

21. A connector member according to claim 19 wherein said plurality of insulation displacement connectors are configured for terminating wires of a first range of wire sizes and wherein said further insulation displacement connector is configured for terminating a wire of a size outside of said first range of wire sizes.

22. A connector member according to claim 19 wherein each of said plurality of insulation displacement connectors and said further insulation displacement connector comprise a pair of cantilevered beams configured for electrically engaging a wire therebetween.

23. A connector member according to claim 19 wherein said first and second connector bases are formed at substantially right angles to said common platform.

24. A connector member according to claim 19 and further including electrically conductive means defining a test point also projecting from said common platform.

25. A connector member according to claim 24 wherein said test point projects from said common platform in generally the same direction as the insulation displacement connectors.

26. A one-piece connector member integrally formed from a single piece of conductive material, and comprising: a first connector base; a plurality of insulation displacement connectors projecting from said first connector base; said insulation displacement connectors of said first plurality of insulation displacement connectors are arranged side-by-side defining a common plane; a second connector base; at least one further insulation displacement connector projecting from said second connector base; a common platform interconnecting said first and second connector bases, said first and second connector bases being formed projecting in the same direction from said common platform.

27. A connector member according to claim 26 wherein said further insulation displacement connector defines a plane located at an angle with respect to the plane defined by said first plurality of insulation displacement connectors.

* * * * *